US007377408B2

(12) United States Patent
Kasting et al.

(10) Patent No.: US 7,377,408 B2
(45) Date of Patent: May 27, 2008

(54) FLUID DISPENSER

(75) Inventors: Thomas P. Kasting, Ft. Wayne, IN (US); Brian R. Law, Leicester (GB)

(73) Assignee: Rieke Corporation, Auburn, IN (US)

( * ) Notice: Subject to any disclaimer, the term of this patent is extended or adjusted under 35 U.S.C. 154(b) by 553 days.

(21) Appl. No.: 10/933,963

(22) Filed: Sep. 3, 2004

(65) Prior Publication Data

US 2005/0061835 A1 Mar. 24, 2005

Related U.S. Application Data

(60) Provisional application No. 60/504,327, filed on Sep. 19, 2003.

(51) Int. Cl.
*B65D 88/54* (2006.01)

(52) U.S. Cl. ..... 222/321.8; 222/340; 222/383.1; 222/385

(58) Field of Classification Search ..... 222/321.8, 222/340, 382, 383.1, 383.3, 402.13, 372, 222/385, 381, 321.7, 182
See application file for complete search history.

(56) References Cited

U.S. PATENT DOCUMENTS 1,466,804 A * 9/1923 Orr ..... 222/144.5
1,739,195 A * 12/1929 Wheeler ..... 74/17.5
1,947,088 A * 2/1934 Johnson et al. ..... 222/318
2,113,022 A 4/1938 Hefti
3,066,832 A 12/1962 Rossetti
3,332,585 A 7/1967 Cox
3,393,840 A * 7/1968 Sundholm ..... 222/324
3,905,520 A 9/1975 Nishioka
5,375,746 A 12/1994 Schaefer et al.
5,381,932 A 1/1995 Humphrey
5,435,463 A 7/1995 Hodgson
5,482,187 A * 1/1996 Poulsen et al. ..... 222/207
5,579,959 A 12/1996 Bennett et al.
6,019,256 A 2/2000 Seltzer

* cited by examiner

*Primary Examiner*—Frederick C. Nicolas
(74) *Attorney, Agent, or Firm*—Woodard, Emhardt, Moriarty, McNett & Henry LLP

(57) ABSTRACT

A fluid dispenser which has a pump assembly having a reciprocable plunger received in a housing having an outlet end for delivery of fluids. A handle is pivotally connected to the housing and is mechanically connected to the plunger of the pump assembly to provide a mechanical advantage. A flexible internal tube connects the reciprocable plunger to a fixed outlet from the housing. The unit maybe field stripped without any special tools.

10 Claims, 6 Drawing Sheets

FLUID DISPENSER

REFERENCE TO RELATED APPLICATIONS

This application claims the benefit of U.S. Provisional Patent Application Ser. No. 60/504,327 filed Sep. 19, 2003, which is hereby incorporated by reference in its entirety.

FIELD OF THE INVENTION

The invention relates generally to fluid material dispensers and more particularly to dispensers having manually operable pumping mechanisms for dispensing condiments, lotions and similar fluids.

BACKGROUND OF THE INVENTION

Manually operated condiment dispensers are commonly used in restaurants, food stands and in commercial food preparation applications to dispense ketchup, mustard, etc. Known dispensers include manually operable pumps for dispensing condiments from a container through a spout. Typically, a single pump stroke dispenses a pre-determined amount of condiment equal to a single serving size portion.

While the invention is useful in dispensing many types of viscous fluids, the invention is especially useful in dispensing condiments, which are commonly served in quick service restaurants and hot dog stands. These condiments include ketchup, mustard, cheese sauce, mayonnaise, tartar sauce and the like which a consumer typically places on food products. However, the invention is not only useful for the dispensing of condiments, but is also useful to the dispensing of fluids in general. For purposes of this discussion, "fluid" is defined as any material or substance that changes shape or direction uniformly in response to an external force imposed on it and applies not only to liquids, but also to finely divided solids and solids generally suspended in a carrier. For illustrative purposes, the dispensing of condiments will be discussed.

At sports stadiums and other mass-attendance public events, food products like hot dogs and hamburgers may be sold to consumers who then take the purchased food products to one or more condiment dispensing stations. These dispensing stations are often subject to a high degree of use due to the relatively large number of consumers who use the dispensing station on any given day or number of days. Since the dispensing stations are subject to a high level of use, they must be durable and preferably of simple design so that operation is intuitive and maintenance can be easily and efficiently achieved.

Many viscous fluid dispensers consist of a piston displacement pump and a dispensing spout. In order to operate these types of condiment dispensers, the user must engage the pump handle with direct downward force. The force required to push down on the pump handles often poses problems to children who lack sufficient strength to properly operate the devices. In addition, the pump handles are typically employed on top of a dispensing container away from the dispensing aperture. This requires the user to hold a condiment receptacle or food item closely underneath the dispensing aperture in one hand while actuating the pump located some distance from the aperture with the other hand as exemplified by U.S. Pat. No. 5,375,746 and U.S. Pat. No. 5,381,932. These dispensers are not only difficult to manipulate, but they also increase the risk that liquid will spill onto the floor or countertop, as the user must concentrate on the pump instead of the liquid pouring out of the end. Reaching over with one hand also brings the user in closer contact with the dispensing end, increasing the risk that liquid will spill on the user's clothing, especially when the dispensing end is moving, as in U.S. Pat. No. 5,381,932.

A further requirement of a fluid dispenser of this general type is that it must be able to be field stripped without any special tools. This is an important requirement for commercial food service businesses since equipment must be cleaned on a regular basis to meet health and other government requirements. The patents noted above pay no special attention to the ability to be field stripped.

SUMMARY

The selected embodiment relates to a fluid dispenser comprising a pump assembly for receiving fluid to be dispensed and being responsive to a displacement input to pump fluid. An elongated housing is connected to the pump assembly and delivers fluid from the pump assembly. A handle is pivotally connected to the housing. A mechanical connection between the handle and the pump assembly provides the displacement input to the pump assembly when the handle is pivoted so that a mechanical advantage is applied to the pump assembly.

In another form of the selected embodiment, a fluid dispenser comprises a pump assembly having a base and a plunger, the plunger having a fluid outlet end and being reciprocable to pump fluid to the outlet end. An elongated housing having a fluid outlet end is connected to the base with the fluid outlet end of the plunger being positioned within, and reciprocable in the housing. A handle is pivotally connected to the housing. A mechanical connection is provided between the plunger and the handle for providing the reciprocable displacement when the handle is pivoted so that a mechanical advantage is applied to the pump assembly. A flexible tube connects the fluid outlet end of the plunger to the fluid outlet end of the housing so that when the handle is pivoted, fluid is delivered from the housing at a position unaffected by displacement of the plunger.

DESCRIPTION OF THE SELECTED EMBODIMENT

For the purposes of promoting an understanding of the principles of the invention, reference will now be made to the embodiments illustrated herein and specific language will be used to describe the same. It will nevertheless be understood that no limitation of the scope of the invention is thereby intended. Any alterations and further modifications in the described processes, systems or devices, and any further applications of the principles of the invention as described herein, are contemplated as would normally occur to one skilled in the art to which the invention relates.

Figure 1:
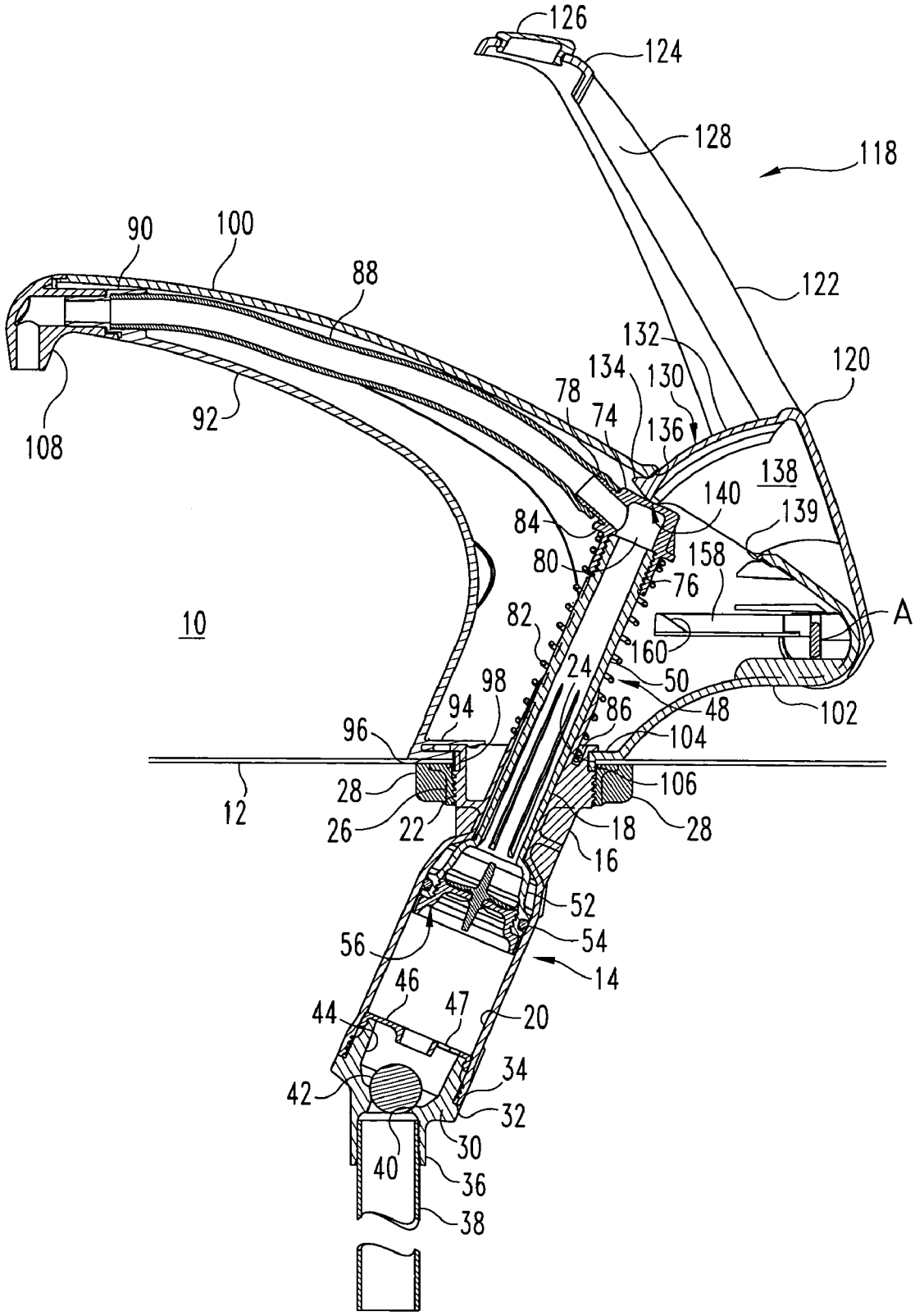
FIG. 1 is a longitudinal section view of a fluid dispenser embodying the present invention, shown in a ready position.

FIG. 1 shows a fluid dispenser 10 usable with a fluid container as exemplified by a horizontal planar cover 12. Typically, cover 12 may be thin stainless steel, either employed as a lid to a fluid container or as a section fastened to a laminated counter top for delivery of a fluid such as a condiment. Dispenser 10 incorporates a pump assembly 14 in widespread use in the fluid dispensing business. Pump assembly 14 is also known in the trade as a pump engine which is generally regarded to be the functional essentials of a fluid pump without a decorative exterior and other cover. Pump assembly 14 comprises a base 16 having a plunger bore 18 and a pumping chamber 20 having a generally cylindrical shape. Housing 16 has a threaded section 22 adjacent an opening 24 in cover 12. A sleeve 26 is internally threaded and adapted to thread over base 16 to hold the lower side, as viewed in FIG. 1, against the inside surface of cover 12. Wings 28 are provided on sleeve 26 to facilitate threading and unthreading without a special tool.

The lower end of pumping chamber 20 has an inlet housing 30 threaded into the open end 32 of pump housing 20. Inlet housing 30 has a shoulder 34 abutting the end 32 of pumping chamber 20 to fix the position of inlet housing 30. Inlet housing 30 has a spigot 36 which receives an elongated tube 38 adaptable to extend to the appropriate bottom section of the fluid container beneath cover 12.

As is noted in FIG. 1, the pump assembly 14 defines an angle with respect to the planar surface of cover 12. Accordingly, inlet housing 30 is designed to have an angled entry of inlet tube 38 so as to allow inlet tube 38 to extend generally vertically downward.

Inlet housing 30 has an inlet orifice 40 connected to inlet tube 38 and having a check ball 42 seated on orifice 40 to permit flow only from inlet tube 38 through orifice 40 to ball chamber 44. A ball retention disk 46 with flow passages 47 (only one of which is shown) to pumping chamber 20, is received within the interior of pumping chamber 20 to maintain check ball 42 within the chamber 44.

Figure 3:
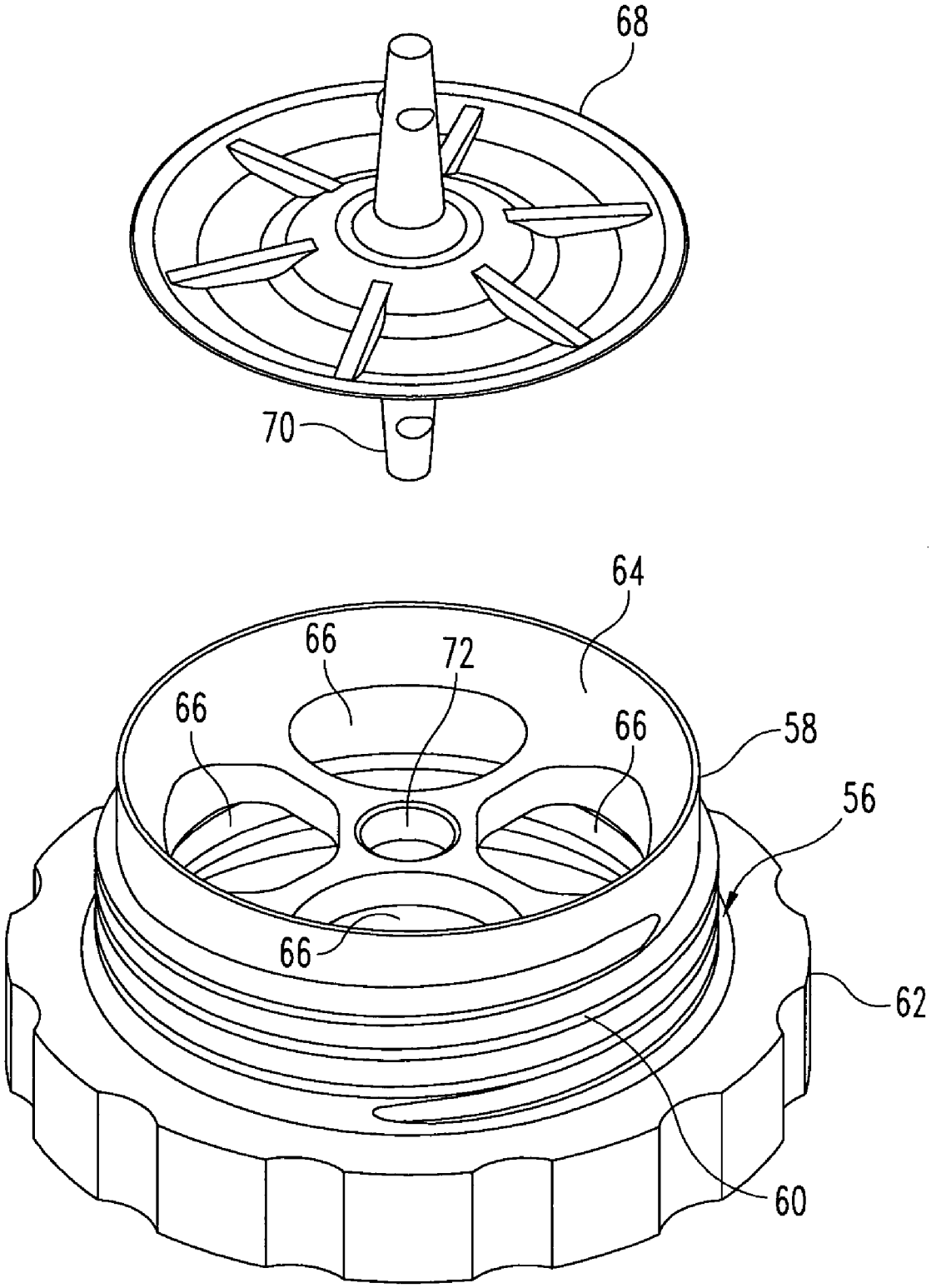
FIG. 3 is an exploded perspective view of a check valve incorporated in a pump assembly of the fluid dispenser of FIG. 1.

A plunger assembly 48 has a tubular plunger 50 extending through and beyond plunger bore 18. Integral with the lower end of plunger 50 is an annular piston 52 having an o-ring 54 slideable along the interior wall of pumping chamber 20 to provide pumping action. An outlet check valve assembly 56 is threaded into the end of the annular piston 52. With specific reference to FIG. 3, outlet check valve assembly 56 comprises an annular check valve holder 58 having threads 60 for connection to the annular piston 52. Check valve holder 58 has a serrated flange 62 to facilitate operator threading and unthreading without special tools. Holder 58 has an end face 64 with a plurality of circumferentially spaced openings 66 to provide fluid flow. An annular elastomeric fluid check valve 68 is positioned over wall 64 and is maintained in coaxial alignment by means of an integral center post 70 retained within central hole 72 of check valve holder 58. Thus, when fluid flow is from openings 66 past elastomeric valve 68, the valve 68 flexes to permit free flow but if the direction of flow is opposite will be retained against the openings 66 and prevent reverse flow. The plunger 50 extends through plunger bore 18 to an outlet cap 74 threaded over the end of plunger 50 at a threaded joint 76. Cap 74 has a tubular outlet section 78 connecting to a central chamber 80. A return spring 82 is positioned over plunger 50 and acts against a shoulder 84 in cap 74 and against an annular recess 86 in base 16. Spring 82 urges the plunger 50 to the illustrated ready position.

Tubular outlet 78 connects with a flexible tube 88 extending to an outlet recess 90 integral with a lower housing 92. Lower housing 92 surrounds a portion of the pump assembly 14 and may provide a decorative cover for the unit in use. Lower housing 92 extends from section 90 to a lower flange 94 abutting the top of housing 16 and a lower flange 96 extending to an axial flange 98 received in housing 16 so that when sleeve 26 is threaded onto housing 16, flange 98 is captured to hold it in place. Housing 92 mates with an upper housing 100 through an overlapping joint (not shown) in FIG. 1 to extend beyond the plunger 50 to a second portion 102 of the housing. The second portion 102 extends to a base flange 104 and an axially extending flange 106 received in housing 16 so that when sleeve 26 is threaded and in place, housing 100 is captured in place.

Figure 4:
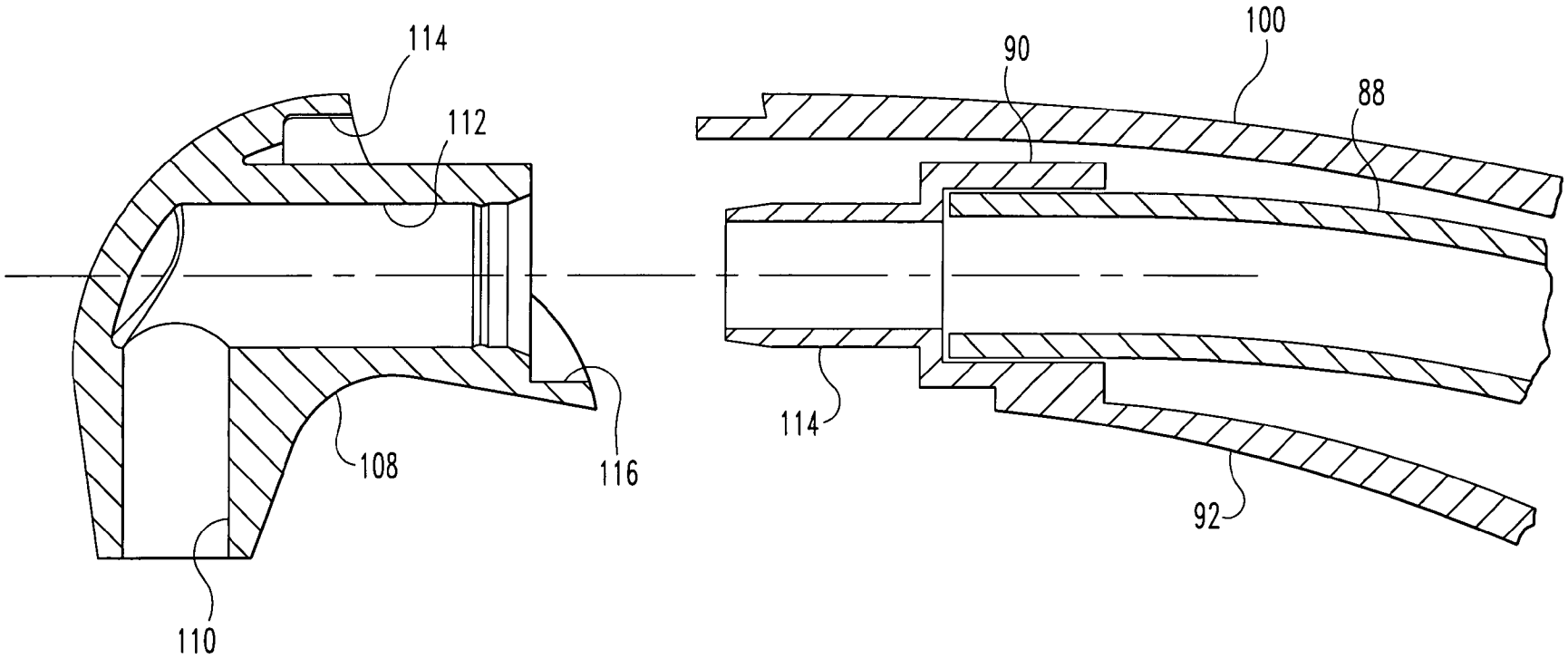
FIG. 4 is a greatly enlarged fragmentary section view of the fluid dispenser of FIG. 1 showing a final outlet spigot of the fluid dispenser.

The end of the combined housing 92 and 100 to the left of FIG. 1 is the outlet end or first position and has an outlet spigot 108. As shown particularly in FIG. 4, outlet spigot 108 functions to provide the ultimate outlet of fluid from the dispenser 10 through passage 110 which connects with a right angle passage 112 that is received over tube 114 of outlet section 90 of lower housing 92. When outlet spigot 112 is installed over tube 114, a flange having an upper section at 114 curving to a lower section 116 slips over the end of housings 100 and 92, respectively, to hold them in place against one another. Outlet spigot 108 is manufactured so that it can be assembled in place to hold the housings together but pulled apart so that they may be separated as described later.

Figure 5:
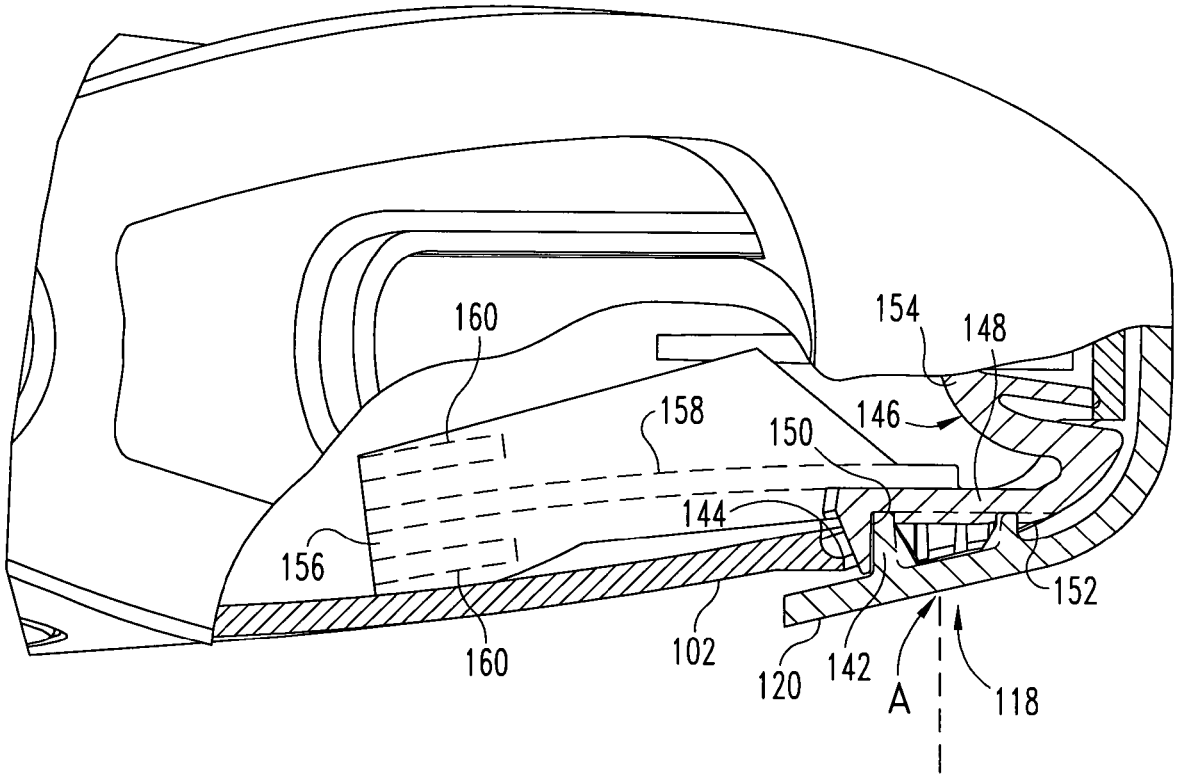
FIG. 5 is a greatly enlarged, fragmentary, partially cut away, plan view of FIG. 1.

In order to alleviate the problems mentioned in the discussion of the background, the invention as shown in FIG. 1 incorporates a handle assembly 118 to provide a mechanical advantage and facilitate stable dispensing of fluids. Handle assembly 118 is formed in a one-piece molded housing, although it may be fabricated in individual components as appropriate for manufacturing feasibility. Referring particularly to FIG. 1 and FIG. 5, handle 118 comprises a molded housing 120 having integral actuating section 122 leading to an operator handle 124. An insert 126 with an anti-friction surface may be employed to improve tactile manipulation of handle 118. Insert 126 may also be color coded to indicate the contents of the fluid container. As shown in FIG. 1, the actuating section 122 has a central opening 128 to lighten handle 118 and to improve its stiffness. The actuating section 122 extends to an integral foot 130 which has a curved forward surface 132 extending to a flange 134 received within an opening 136 in upper housing 100. Foot 130 has side walls 138, only one of which is shown because of the section view of FIG. 1. Side walls 138 and flange 134 cooperate to define a curved surface 140, which abuts the head of cap 74.

Referring particularly to FIG. 5, the handle 118 is pivoted in the second portion 102 of upper housing 100. Housing 120 of handle 118 has a pair of trunions 142, only one of which is shown in FIG. 5, which are positioned in opposed holes 144 in the second portion 102 of upper housing 100. In order to provide for removable retention and journaling of handle 118, a clip assembly 146 is provided. Clip assembly 146 has one portion shown in FIG. 5 and a mirror portion, shown in FIG. 1 and FIG. 2, to journal respective trunions 142. Clip 146 has a journal section 148 comprising a circular recess 150 for receiving each trunion 142. Thus, the handle 118 pivots about axis A at a point spaced from the plunger 50 of pumping assembly 14. The journal section 148 has a ramp 152 in the direction extending away from the pumping element 14 for assembly purposes, as will be described later. Clip assembly 146 may be formed from material having superior lubricity like a high density polyethylene.

A flexible C center section 154 permits the clip to be compressed for insertion and then to expand into holes 144 to embrace the trunions 142. The flexible center section 154 is compressed by operator manipulation of a pair of fingers 156. Although not shown in the drawings, the fingers 156 are positioned so that they overlap one another when both are moved toward the centerline of the housing. In order to permit operator manipulation, ribs 158 and 160 are provided on fingers 156. As shown in FIG. 5, the rib 158 extends the length of the finger 156 and the ribs 160 are triangular and extend a short distance from the free end of finger 156. In addition, the fingers as shown in FIG. 5 are on its bottom side and the mirror finger shown in FIG. 1 has ribs 158 and 160 on the top side. This is so the ribs 158 and 160 will not interfere with compression of the fingers and therefore the C section 154 when the fingers are compressed to permit removal of handle assembly 118.

To assemble the dispenser 10, the lower housing 92 is placed against base 16 and the flexible tube connected between section 90 and the plunger cap 74. The clip 146 is compressed and inserted into the holes 144 in upper housing 100. The handle assembly 118 is positioned over upper housing 110 so that forward lip 134 is in line with opening 136. It should be noted in FIG. 1 that the side walls 138 are beveled at their back end at 139 so that lip 134 and bevel 139 form parallel surfaces that permit insertion of foot 130 into opening 136 only when lip 134 is in line with opening 136. At this point, the trunions 142 approach ramps 152. Further motion of the handle 118 causes the trunions 142 to ride up over ramp 152, depressing the journal sections 148 so that the trunions 142 are snapped into the circular recesses 150 when the forward curved wall 132 and lip 134 are against the forward portion of opening 136. Once handle 118 is in place, the upper housing 100 is placed against the base 16 and fitted over lower housing 92 by means of the over-lapping joint. At this point the outlet spigot 108 is inserted over tubular end 114 to hold the delivery end of upper housing 100 and lower housing 92 together. At this point, the housing 16 is inserted in the opening 24 for cover 12 and sleeve 26 threaded on housing 16 to abut the bottom of cover 12 and also hold upper and lower housings 92 and 100 against base 16.

The dispenser 10 is now in a position to deliver fluid. A customer simply depresses handle 118 by grasping the free end adjacent insert 126 and depressing it downward to the position shown in FIG. 2. Because of the curvature of flange 134 and side walls 138 where they contact the flat top of plunger cap 74, side loading on plunger 50 is minimized, if not eliminated. This greatly decreases any plunger binding.

The delivery end of the housing projects to a fluid delivery end away from pump assembly 14 and the pivot point of the handle 118 extends in an opposite direction. This permits a maximum mechanical advantage to be applied by handle 118 to the pump assembly plunger 50 while minimizing the overall envelope of the dispenser 10. It should also be noted that because the pump assembly is angled with respect to the cover 12, the outlet spigot 108 is elevated above the cover 12 sufficiently to permit both a food object such as a hot dog and a customer's hand to be placed underneath the outlet spigot 108. It should also be noted that the direction of displacement of the plunger 50 is generally perpendicular to a line between the outlet end of the housing and the pivot point for the handle, the line forming an acute angle with respect to the cover 12.

Because the liquid is connected to the outlet spigot by means of the flexible tube 88, the unit as presented to a customer has a clean appearance without the motion of the movable plunger. This permits a standard high-volume, low cost pump assembly to be in incorporated in a unit that has premium features with an easily manipulatable handle and minimum of moving parts.

Figure 2:
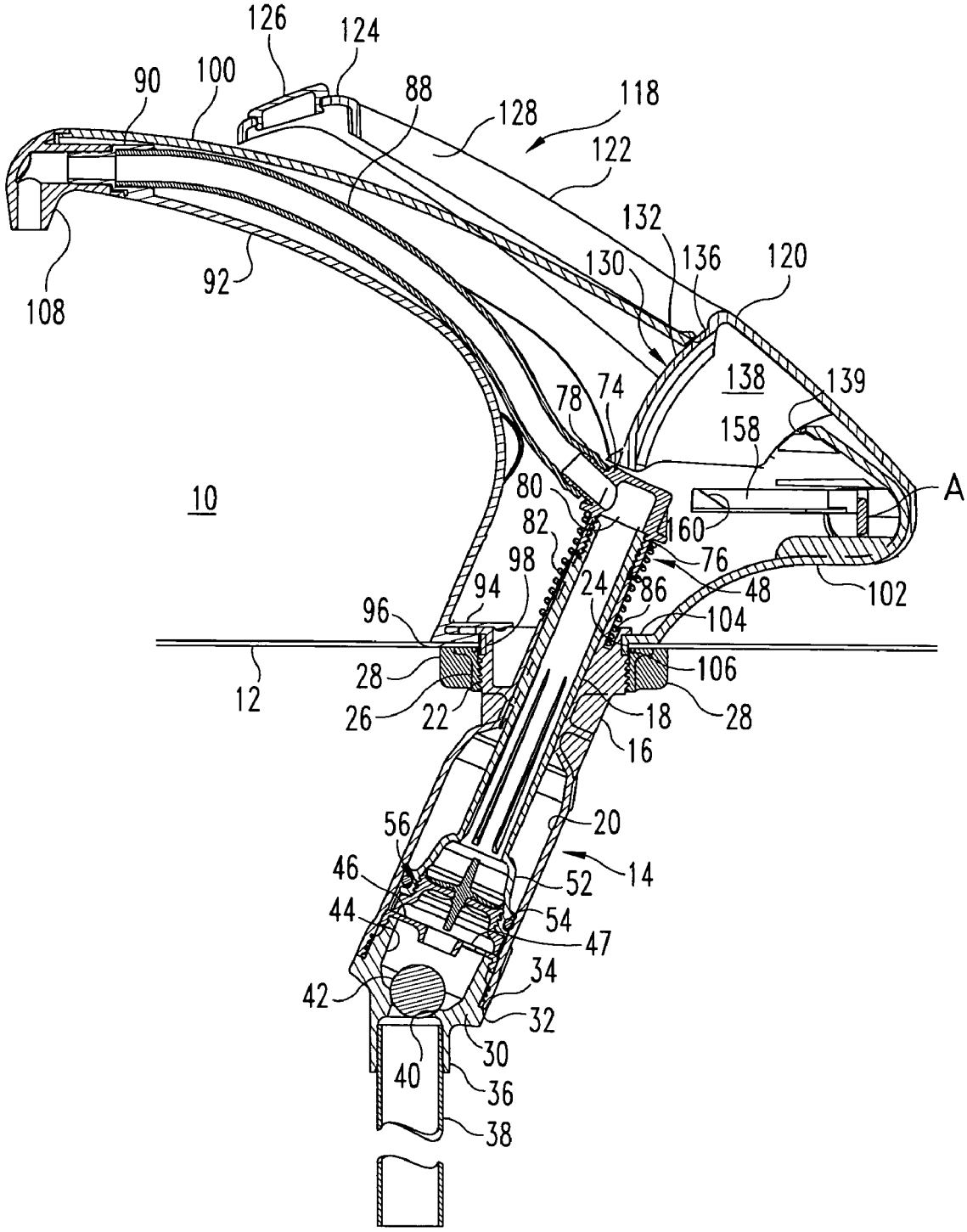
FIG. 2 is a longitudinal section view of the fluid dispenser of FIG. 1 shown at the completion of a delivery stroke.

It should also be noted that the fluid dispenser 10 may be field stripped without any special tools. The wings 28 on sleeve 26 permit an operator to apply sufficient force to unthread sleeve 26, thus permitting housing 16 to be removed from cover 12, the spigot 108 removed from the delivery end of the unit and the upper and lower housings 100 and 92 to be removed from one another to provide cleaning. If it is desired to remove the handle assembly 118, the ribs 158 and 160 on the clip 146 are squeezed together to clear the trunions 142 and permit the handle 118 to be removed in a direction straight to the right as shown in FIG. 1. It should also be noted that the only position handle 118 can be in to achieve this is in the fully extended ready position as shown in FIG. 1. Once the handle has been pivoted as if to begin a pumping stroke, as shown in FIG. 2, the curved side walls 138 prevent removal of the handle 118.

Figure 6:
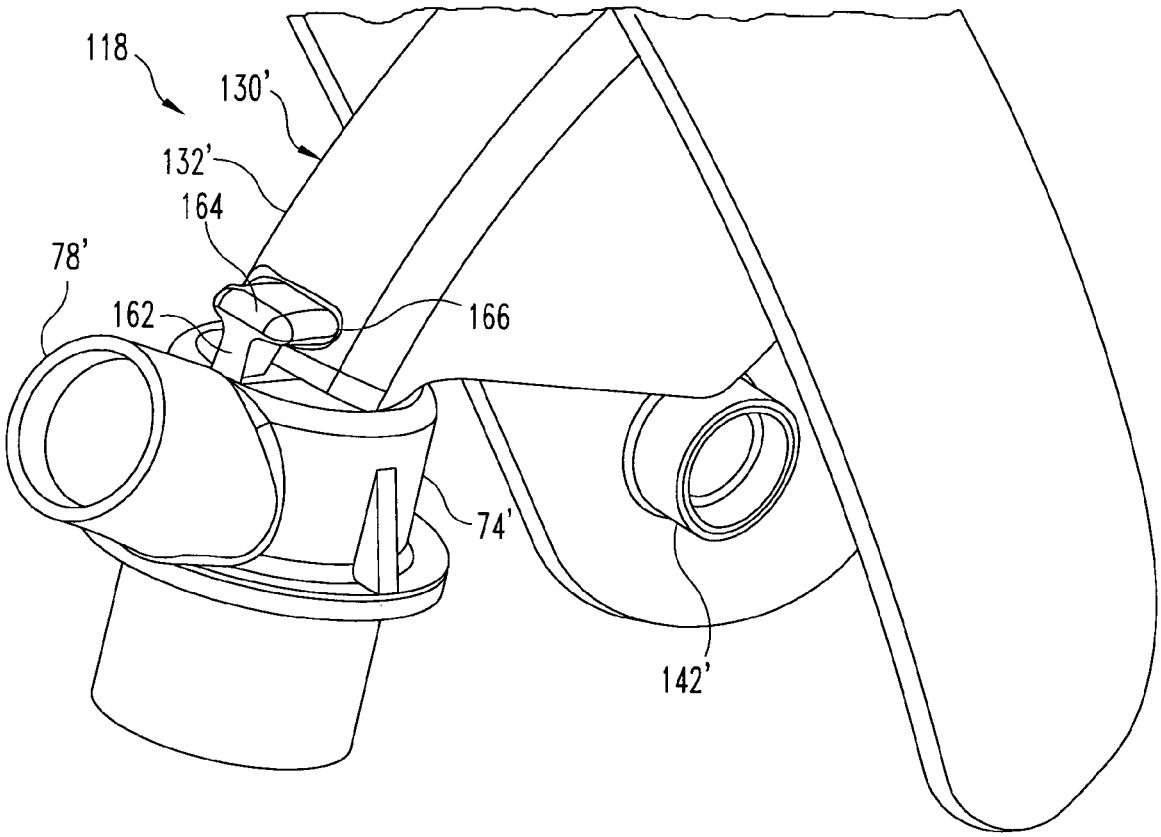
FIG. 6 is an enlarged fragmentary perspective view showing an alternative interconnection to the pump assembly incorporated in the fluid dispenser of FIG. 1.

The assembly shown in FIGS. 1 through 5 has a mechanical interface between the handle 118 and the plunger head 74 that operates only in a direction to depress plunger 50. In this case, the spring 82 provides adequate return to bring the handle 118 back to its ready position and lip 134 prevents the handle 118 from being pivoted out of the housing. If it is desired to limit the pivoting of handle 118 by means of the plunger 50, the interconnection shown in FIG. 6 may be employed. FIG. 6 shows a fragmentary view of the fluid dispenser of FIG. 1 with a focus only on the interconnection of the cap 74 of plunger 50 to the foot 130 of handle 118. In this case, like reference characters will be used for corresponding parts but with a prime. In this case, head 74' has an integral T head 162, which incorporates a flanged section 164, received in a slot 166 of the curved forward wall 132' of foot 130'. Thus it can be seen that movement of the handle assembly 118 in a downward direction positively depresses cap 74' of plunger 50, and that movement of the handle 118 to the ready position also positively urges plunger 50 by virtue of the slot 166. The limit on upward travel of plunger 50 then prevents handle 118 from being pivoted out of the housing.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fluid dispenser comprising:

a pump assembly for receiving fluid to be dispensed and responsive to a displacement input to pump said fluid;

an elongated housing connected to said pump assembly and delivering said fluid from said pump assembly, said housing having a first portion extending from said pump assembly to a fluid delivery end and a second portion extending in an opposite direction from said first portion, said housing further including a pair of pivot journal points;

a handle pivotally connected to said housing, said handle having a pivot location, said pivot location being positioned on said second portion, wherein said handle having a pair of trunions receivable over said journal points to provide said pivotal connection;

a mechanical connection between said handle and said pump assembly for providing said displacement input when said handle is pivoted, so that a mechanical advantage is applied to said pump assembly; and wherein said housing has a pair of circular openings co-axial with said journal points and said housing further comprises a flexible clip having a pair of circular recesses for receiving said trunions, said clip being removeably received in said handle so that said circular recesses are held in said housing openings, said clip being elastically deformable to permit said trunions and said handle to be removed from said housing.

2. Apparatus as claimed in claim 1 wherein said clip has ramped surfaces facing the end of the second portion of said housing for assembly of said handle onto said housing by pushing said trunions over said ramped surfaces and into said circular recesses.

3. Apparatus as claimed in claim 2 wherein said handle has an opening between said pivot and the free end of said handle.

4. The fluid dispenser of claim 3 wherein said pump assembly receives displacement input through an integral T-shaped element and wherein said foot is slotted to embrace said T-shaped element to provide bi-directional input to said pump assembly from said handle.

5. A fluid dispenser comprising:

a pump assembly for receiving fluid to be dispensed and responsive to a displacement input to pump said fluid;

an elongated housing connected to said pump assembly and delivering said fluid from said pump assembly, said housing having a first portion extending from said pump assembly to a fluid delivery end and a second portion extending in an opposite direction from said first portion;

a handle pivotally connected to said housing, said handle having a pivot location positioned on said second portion;

a mechanical connection between said handle and said pump assembly for providing said displacement input when said handle is pivoted, so that a mechanical advantage is applied to said pump assembly, said mechanical connection comprising a foot affixed to said handle and adapted to abut said pump assembly for displacement thereof, wherein said housing having an opening therein for receiving said foot to transfer displacement of said handle to said pump assembly, wherein said pump assembly having a substantially flat head for receiving said displacement input and wherein said foot having a curved surface for abutting said flat head whereby side loads on said pump assembly ale minimized; and wherein said foot has curved side walls extending into said hole in said housing and a lip adjacent the curved pump assembly contacting surface for limiting pivoting movement of said handle away from said pump assembly by abutting said hole, said curved side walls having an end bevel cooperating with said lip to permit removal of said handle and foot from said housing only when said lip abuts said hole.

6. A fluid dispenser comprising:

a pump assembly having a base and a plunger having a fluid outlet end and being reciprocable to pump fluid to said fluid outlet end;

an elongated housing having a fluid outlet end and connected to said base, the outlet end of said plunger being positioned within and reciprocable in said housing, a handle pivotally connected to said housing;

a mechanical connection between said plunger and handle for providing said reciprocal displacement when said handle is pivoted so that a mechanical advantage is applied to said pump assembly;

a flexible tube connecting the fluid outlet end of said plunger to the fluid outlet end of said housing whereby when said handle is pivoted, said fluid is delivered from said housing at a position unaffected by displacement of said plunger; and wherein said pump assembly base has a circular configuration and said housing comprises:

upper and lower halves connected to each other at an overlapping joint, each half having a semicircular opening to embrace the circular configuration of said pump assembly base when said halves are connected to each other.

7. The fluid dispenser of claim 6 wherein said upper and lower halves have a flange at said semicircular opening; and said apparatus further comprises a collar releasably connected to the pump assembly base and overlapping said flanges to maintain said upper and lower housing halves together.

8. The fluid dispenser of claim 7 for use with a fluid container having a generally planar top to which said dispenser is affixed, said top having a circular opening corresponding to the circular configuration of said base, said base and circular flanges of said halves being inserted through said opening and wherein said base has threads and said collar has corresponding inwardly-facing threads to releasably connect said dispenser to said planar top.

9. The fluid dispenser of claim 8 wherein said threaded collar has a pair of wings radially extending therefrom to facilitate threading and unthreading of said collar.

10. The fluid dispenser of claim 6 wherein said housing further comprises an outlet having a passage therethrough fluidly connected to said flexible tube, said outlet overlapping the upper and lower halves of said housing near the delivery end thereof to maintain the housing halves together.

* * * * *